United States Patent [19]

Egger et al.

[11] 4,128,992

[45] Dec. 12, 1978

[54] ROCKING MOTOR FOR LOW COST QUARTZ WATCH

[75] Inventors: Joseph Egger, Pforzheim; Franz Mayer, Birkenfeld; Herbert Schwartz, Wurmberg; Walter Södler, Pforzheim-Buchenbronn, all of Fed. Rep. of Germany; Jean Suard, Besancon, France; Wilhelm Tilse, Birkenfeld, Fed. Rep. of Germany

[73] Assignee: Timex Corporation, Waterbury, Conn.

[21] Appl. No.: 779,652

[22] Filed: Mar. 21, 1977

[30] Foreign Application Priority Data

Apr. 17, 1976 [DE] Fed. Rep. of Germany ..... 2617077

[51] Int. Cl.[2] ..... G04C 3/00

[52] U.S. Cl. ..... 58/23 D; 58/2; 58/59

[58] Field of Search ..... 58/2, 23 D, 59

[56] References Cited

U.S. PATENT DOCUMENTS

| | | | |
|---|---|---|---|
| 3,775,963 | 12/1973 | Clapham | 58/23 D |
| 3,902,310 | 9/1975 | Kreidler | 58/23 D |
| 3,999,369 | 12/1976 | de Valroger et al. | 58/23 D |

*Primary Examiner*—Robert K. Schaefer
*Assistant Examiner*—Leonard W. Pojunas, Jr.
*Attorney, Agent, or Firm*—William C. Crutcher

[57] ABSTRACT

A rocking motor for driving an indexing element in a quartz controlled analog wristwatch is impulsed once per minute. The indexing element and the indexed "center" wheel are carried between parallel shunt plates holding the permanent magnet. The driving element is deflected by a pulse from its rest position to tension a spring, and the minute wheel is indexed when the driving element is returned by the reset spring.

14 Claims, 5 Drawing Figures

Fig. 3
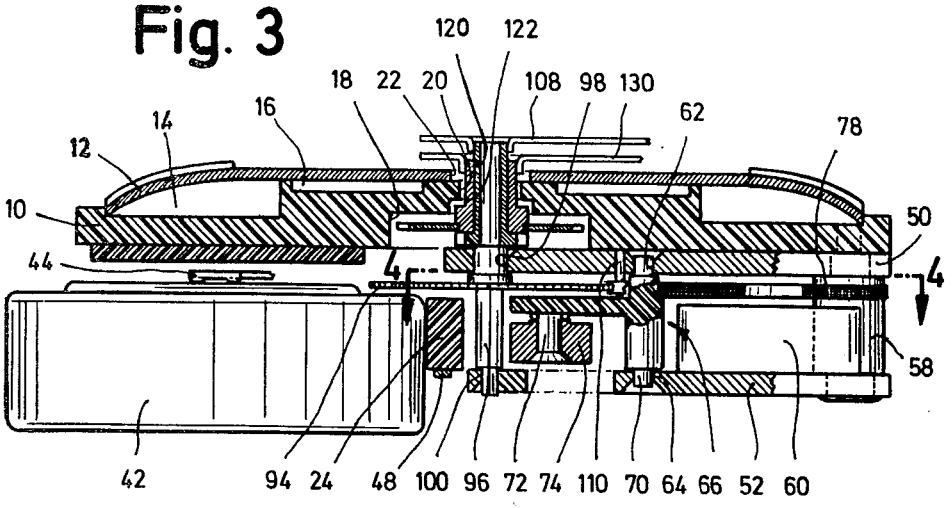
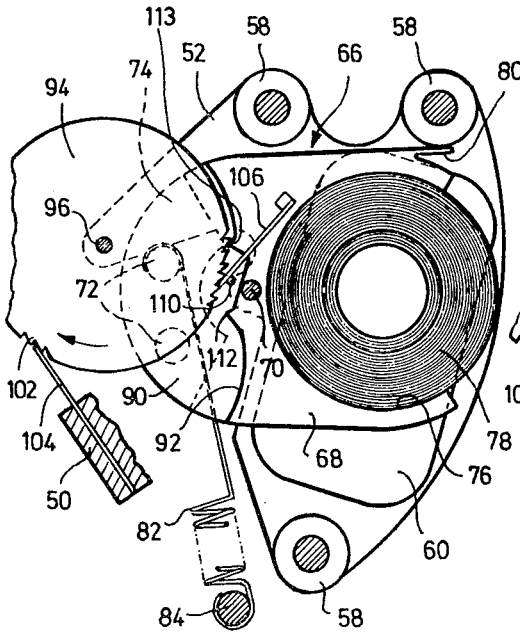
Fig. 4
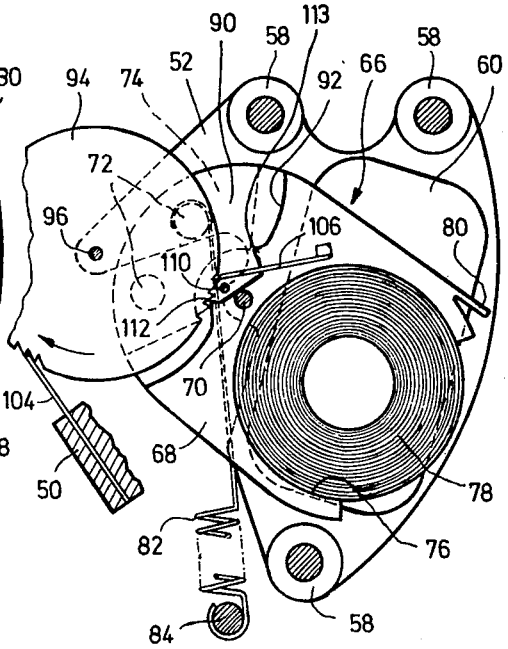
Fig. 5

ROCKING MOTOR FOR LOW COST QUARTZ WATCH

BACKGROUND OF THE INVENTION

The invention relates to a quartz controlled analog wrist watch comprising a quartz controlled pulse generator and a driving element for driving a first toothed wheel of a gear train, said driving element being mounted for pivoting about an axis, a coil connected to receive the output pulses of the pulse generator, and a permanent magnet, which are movable relative to each other, for deflecting said driving element from a rest position and further comprising a reset spring to swivel back the driving element.

In a quartz wrist watch of the aforementioned kind (Quartz Wrist Watch Arctos-QUARTZ by the firm of Philip Weber KG, Pforzheim, Germany) the driving element has the form of a conventional, coil-carrying balance wheel of an electric wrist watch, and a conventional hairspring is provided as reset spring. The driving element indexes a second wheel of the gear train by means of a conventional pin-type escapement, and one indexing step is effected during each half-cycle.

It is also already known to provide quartz controlled clocks (desk, wall and alarm clocks) with a driving element which swings to and fro and indexes a second wheel of the gear train directly, so that these clocks have a jumping second hand (see German Utility Model Specification No. 7,146,975). In such cases too, the pivotable driving element carries a coil which cooperates with a permanent magnet and under the influence of electrical impulses occuring at one second intervals deflects the driving element from its rest position against the action of a reset spring, whereupon the driving element is then returned by the reset spring. When the driving element is deflected from its rest position, not only is the reset spring tensioned, but also the second wheel is simultaneously indexed one step further by means of a pawl mounted on the driving element. This principle is disadvantageous in that relatively powerful driving impulses are required, since not only the indexing resistance of the gear train has to be overcome, but also the reset spring has to be tensioned simultaneously.

However, a quartz controlled clock is also known wherein a coil-carrying driving element which swings to and fro relative to a permanent magnet tensions only a reset spring when it is deflected from its rest position by the electrical pulses occuring at 1 second intervals; in this case, the reset spring which is in the form of a leaf spring swivels an indexing lever mounted coaxially with the second wheel, said indexing lever carrying a pawl by means of which it indexes the second wheel one step further when the reset spring swivels back the indexing lever and the driving element (see German published patent application No. 2,408,538).

The success of quartz controlled wrist watches is mainly due to its theoretically high accuracy, since in advertising it is argued that the time error amounts to a maximum of a few seconds per month. This, however, is not the case with known analog wrist watches because, even during normal use, the components of a wrist watch are exposed to considerable accelerations, and practice has shown that the torque occurring at the rotating or swinging driving elements and at the second hand of a wrist watch may be quite sufficient to index it by one second even without an electrical impulse. However, this makes the theoretical high accuracy of a quartz controlled analog wrist watch unachievable. This applies to a far greater extent to wrist watches which are exposed to heavy vibrations transmitted to the hands and arms of the person wearing the watch, for example, when operating certain machinery or riding a bicycle or motor bike.

SUMMARY OF THE INVENTION

The object of the invention is to produce a quartz controlled analog wrist watch, which even under rough operating conditions exhibits the accuracy theoretically obtainable with a quartz controlled watch, and yet which can be manufactured simply and therefore at low cost. The basic concept of the invention is to abandon the second indication, so that only 1/60 of the otherwise necesssary driving pulses must be produced. Pulse strength can therefore be multiplied while the energy consumption remains the same; this enables the holding forces acting on the driving element and on the toothed wheel to be indexed by the driving element to be made considerably larger than in the known wrist watches with a jumping second indication.

According to the invention, this concept may be realized in that the pulse generator is provided with sufficient frequency stages such that the output pulses deflecting the driving element are 1 minute pulses and the first toothed wheel is the "center" wheel of the gear train being directly indexed by the driving element in such a way that when the latter is deflected, the reset spring is tensioned and the minute wheel is indexed only when the driving element is returned by the spring.

Since, as mentioned above, the strength of the driving pulses of the inventive watch can be multiplied as compared with known watches with second-wise motion, and further, owing to the fact that the center wheel is only indexed when the driving element is returned by the spring, only the forces of the reset spring must be overcome when the driving element is deflected. Thus, the reset spring can be designed so that it holds the driving element in its rest position with a considerable torque and thus prevents the gear train from undesired indexing as a result of shocks. A further advantage of the wristwatch according to the invention is that it is capable of indexing a day-date-display in one single step and not in 60 steps, as is the case in the known wrist watches with second-wise motion. Since the indexing of the center wheel is caused by the reset spring when the driving element is returned by the spring, shocks and abrupt rotating movements cannot prevent correct time indexing even if they oocur during the indexing of the day-date-display. Since, in order to obtain reliable indexing, the angle of rotation of driving elements swinging to and fro is always chosen large enough so that the next tooth of the tooth wheel to be indexed is definately skipped, some lost motion results when the driving element is returned by means of its reset spring before the indexing tooth wheel begins; this measure has a very advantageous effect on the wristwatch according to the invention, for during the initial phase of the swivelling back motion part of the energy stored in the tensioned reset spring can be converted into kinetic energy of the driving element, before the indexing motion of the minute wheel begins. The watch according to the invention is also particularly advantageous with respect to noise development, for the following two reasons: While the driving element is being deflected from its rest position the entire electric energy consumed can be stored in the reset spring and a substantial part of this energy is consumed by the indexing of the minute wheel during the return motion, so that the driving element has only a small amount of kinetic energy left when it arrives in its rest position and comes to rest there at a stop member. On the other hand, if a toothed wheel is indexed when the driving element is deflected from its rest position, during the return motion the energy stored in the reset spring will likewise be released and must be consumed in its entirety when the driving element strikes a stop member defining its rest position, which results in a correspondingly loud noise.

Finally, it should be mentioned that in contrast to all other watches which run accurately, high demands do not have to be made on the quality of the bearings in the construction according to the invention, not only because the strength of the driving pulses can be multiplied as compared with known watches, but also because of the fact that within a certain time the transition from state of rest with correspondingly high friction coefficients to the state of motion has to be effected 60 times less often than in a watch with second-wise motion.

The invention could not be suggested by the prior art because at first sight it appears quite nonsensical to omit the second indication in a watch which runs accurately, however, practice has proven that in most cases, a second indication is never required, and it is quite adequate if the minute is indicated exactly.

One can obtain a particularly flat design for the watch according to the invention, if the minute wheel extends between two shunt plates of the permanent magnet which are disposed parallel to one another and in which the driving element and the center wheel are mounted, for this results in a particularly compact unit consisting of the two shunt plates, the permanent magnet, the driving element, its reset spring and the center wheel with its axis mounted in the shunt plates; this unit can be preassembled and then simply inserted into the movement of the watch.

In a preferred embodiment of the invention further parts of the gear train are mounted at the pre-assembled unit consisting mainly of the two shunt plates, the driving element and the center wheel and so it is practical to mount an intermediate wheel, which is driven via the minute wheel axis on at least one of the shunt plates, and the hour wheel on the center wheel axis, for in this way all movable parts of the drive means and the gear train are comprised and supported by the above-mentioned unit, so that the watch can be substantially pre-assembled and the pre-assembled module can then be mounted on a base plate or the like. It should be mentioned in this connection, that according to the structural layout, the intermediate wheel axis can be mounted in one or both shunt plates. Furthermore, the hour wheel can be mounted on the center wheel axis either directly or by interposition of a bearing tube.

Since space is required in an outer annual area of wrist watches for day-date-display elements, corresponding space is available for other components in the central area of the watch. It is therefore desirable to arrange the intermediate wheel and the hour wheel outside the shunt plates and on the side of that shunt plate facing the front side of the watch, in order to make use of the space available in the central area of the watch, and obtain a watch of particularly flat construction.

In the known controlled analog wrist watch described previously, the driving element is a balance-wheel-like part. The basic principle of the construction according to the invention enables the driving element to take the form of a plastic body with pivot pins formed to it, which is made possible by the fact that no special demands need to be made on the quality of the bearings in the watch of the invention. Thus, the driving element including its pivot pins can be produced as a cheap plastic injection molded part.

In order to prevent with absolute certainty the possibility of the inventive watch not being indexed at the correct time as a result of shocks, in a preferred embodiment of the inventive watch further measures are provided to block the center wheel in the rest position and/or the deflected position of the driving element; firstly, the driving elment carries a resilient arm for indexing the minute wheel, said arm engaging in the teeth of the center wheel when the driving element is in its position of rest, and being prevented from deflection by means of a stop member. Therefore, the resilient arm serving to index the center wheel cannot be disengaged from the teeth of the center wheel by a shock which could have the effect of rotating the minute hand in a clockwise direction — of course, a resilient pawl prevents the minute wheel from turning back.

In order to further increase the guarantee against undesired rotation of the center wheel it is recommended that the driving element be provided with a projection which engages in the teeth of the center wheel when the driving element is in its position of rest. This results in the advantage that the resilient arm serving to index the center wheel cannot be damaged when the watch is being set, even if substantial torque is to be applied for moving the hands. In order to block the center wheel when the driving element is deflected, the latter has a projection, more particularly a nose formed to it, which in the fully deflected position engages in the teeth of the minute wheel. This projection can also correct an incorrect position of the center wheel caused by a shock during the duration of a driving pulse.

In order not to create disturbing noise when the driving element swings back under the influence of the reset spring, the driving element includes a flexible zone, more particularly a resilient tongue formed to it, which in the position of rest abuts a stop member. Particularly if the driving element has an injection molded plastic body, a relatively soft elastic resilient tongue can be provided without extra cost.

Even if the driving element does not carry the permanent magnet, and only the coil, the fact that the specific gravity of the coil material is higher than that of plastic must be taken into consideration. In order to avoid the driving element being unbalanced, at least as far as possible, on one side of its pivot axis the driving element is approximately as thick as the flat coil carried by it, while its thickness on the other side of the pivot axis is greater. Since the permanent magnet must be arranged below or above the coil, which results in a certain minimum spacing of the shunt plates from each other, the space between the shunt plates on the other side of the pivot axis of the driving element can be used for a counterweight, which compensates for the coil mass.

A particularly flat design will be obtained if the driving element includes a step in the area of its pivot axis, which provides for a recess on the side of said axis facing away from the coil, into which the center wheel extends.

DRAWING

Further features, advantages and details of the invention are disclosed in the enclosed claims and/or the following description and the enclosed drawings of a preferred embodiment of the wrist watch of the invention, in which:

FIG. 3 is a cross-section along the line 3—3 in FIG. 1;

FIG. 4 is a cross-section along the line 4—4 in FIG. 3, illustrating the driving element assuming its position of rest and FIG. 5 is an illustration corresponding to FIG. 4, but where the driving element is in its fully deflected position.

DESCRIPTION

Figure 1:
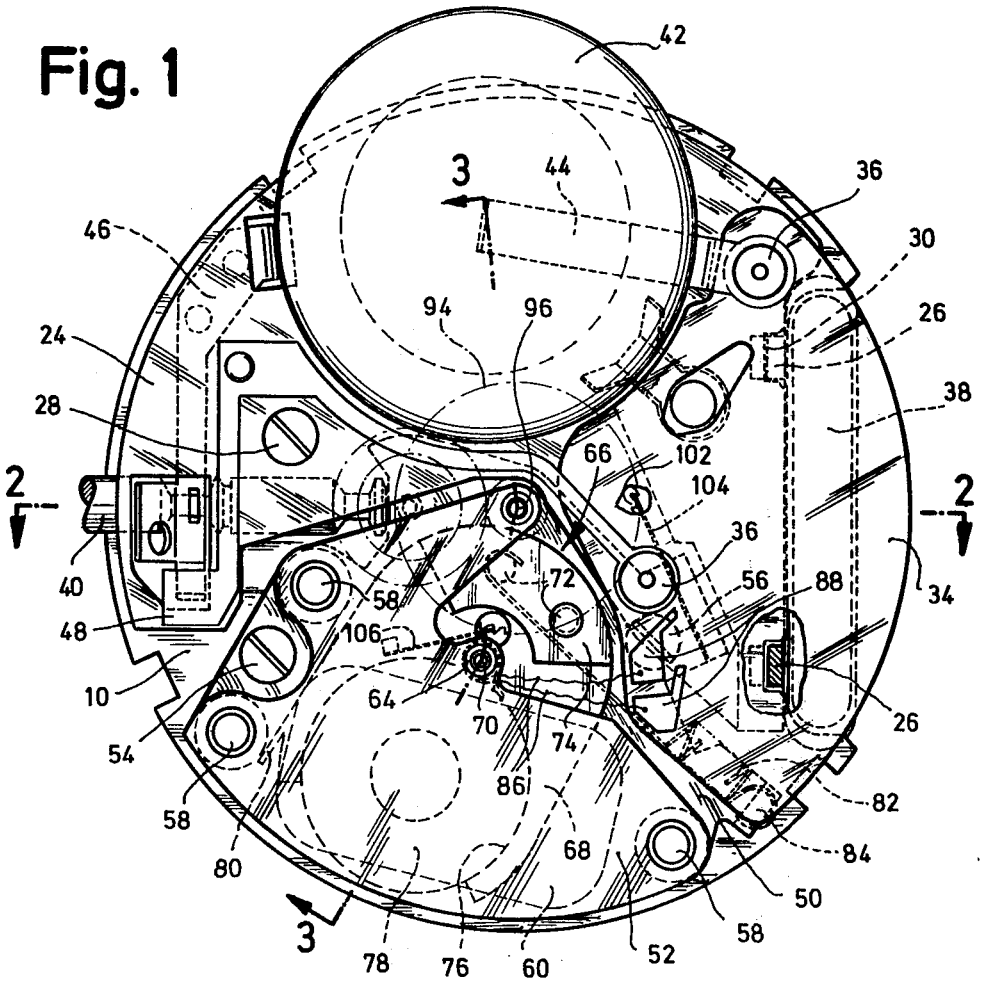
FIG. 1 shows the movement of this watch as seen from the rear.
Figure 2:
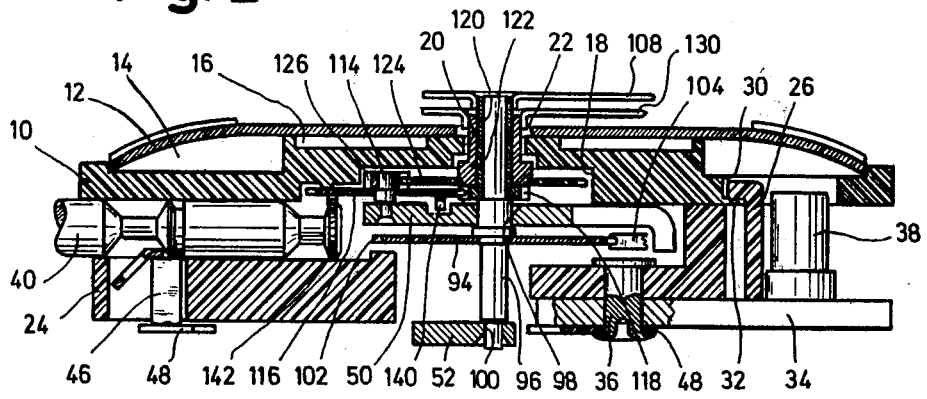
FIG. 2 is a cross-section along the line 2—2 in FIG. 1.

As shown in FIGS. 1 to 3 the watch comprises a front plate 10 serving as supporting element to which a dial 12 is secured. The latter covers two annular recesses 14 and 16 on the front side of the front plate 10, in which ring shaped elements indicating the date and weekday and not shown in the drawings, can be mounted. On the rear side the front plate has a recess 18 in its center for a gear train which will be described later. Finally, the front plate and the dial 12 are provided with central openings 20 and 22.

A plastic carrier plate 24 is secured to the rear side of the front plate 10 by means of two-L-shaped arms 26 formed integral with it, and a screw 28, the latter engaging into a threaded bore, not illustrated, in the front plate 10, while the arms 26 extend with their bent ends into an opening 30 in the front plate 10 and engage from behind a projection 32 on the front plate. A printed circuit plate 34 is secured to the rear side of the carrier plate 24 by means of rivet-like fastening elements 36, said plate bearing a quartz accomodated in a housing 38 and an integrated circuit, not described in further detail, which comprises an oscillator including the quartz and with subsequent frequency divider stages and a driver. It should be designed in such a way as to provide on pulse of a certain polarity each minute. Since corresponding circuits with a pulse repetition frequency of 1 HZ belong to the prior art and the circuit for the watch of the invention can simply be obtained by reducing the output frequency by further divider stages to one pulse per minute, it is not necessary to illustrate or describe the circuit in detail.

Between the front plate 10 and the carrier plate 24 a setting stem 40 is disposed, which not only serves to set the hands of the watch according to the invention in a manner which will be described later, but also to interrupt the circuitry between a battery 42 and the circuit described in the foregoing. The negative pole of the battery is permanently connected to the circuit via a contact strip 44, while a contact strip 46 contacting the positive pole of the battery is only in electrical contact with a contact strip 48, which leads to the printed circuit plate 34 when the setting stem 40 is pulled out. When the setting step 40 is pressed in, the electrical connection between the contact strips 46 and 48 is interrupted, however, this does not have to be dealt with in further detail since it is not a subject of the invention.

FIG. 3 shows in detail the "motor" of the watch according to the invention. This module consists of two shunt plates 50 and 52 held at a distance from each other, the front shunt plate 50 being secured to the front plate 10 by means of two screws 54 and 56 which are shown in FIG. 1. In order to hold the shunt plates 50 and 52 together and at a distance from each other, three pillars 58 are provided, which can contain screws which are not further illustrated. Thus, by loosening the screws 54 and 56 the module comprising the two shunt plates can be removed from the watch.

As shown in FIG. 3, the rear shunt plate 52 carries a permanent magnet 60, which should be an elongated magnet with a north and a south pole next to each other on each of its main surfaces and polarized perpendicularly to the plane of the shunt plates, as is often used in electric wrist watches. A driving element designated in its entirety by 66 is pivotably mounted in bearing bores 62 and 64 of the shunt plates, said driving element having a plate-shaped plastic body 68 with integral pivot pins 70 which engage into the bearing bores 62 and 64. Furthermore, pins 72 which hold a counterweight 74 are integral with the plastic body 68. On the side of the pivot pins facing away from the counterweight the plastic body 68 has an almost circular recess 76 in which a coil 78 glued to the plastic body is positively held. The mass of the counterweight 74 is selected such that the unbalance of the driving element 66 originating from the coil is at least almost compensated for. Finally, a resilient tongue 80 is integral with the plastic body 68, said resilient tongue, when the driving element is in its position of rest, as shown in FIG. 4, abutting one of the pillars 58 under the influence of a reset spring 82 in the form of a screw spring which on the one hand engages one of the pins 72 of the driving element 66 and on the other hand an abutment 84 fixed to the frame.

As shown in FIG. 1, two connecting wires 86 of the coil 78 are wound in a counterclockwise direction around one of the pivot pins 70 of the driving element 66 and then led to two connections 88 of the electric circuit. The direction in which the connecting wires coming from the coil 78 are wound around the pivot pin 70 corresponds to the direction of rotation of the driving element 66 when it is deflected from its rest position. Guiding the connecting wires in the manner disclosed by the invention causes the connecting wire turns not to tighten when the driving element is deflected, but rather to open out, furthermore, when the driving element moves to and fro and when vibrations occur, the critical load for the alternating bending stength of the wires is not exceeded at any point.

The quartz-controlled drive circuit provides one drive pulse each minute at the connections 88 and the polarity of this drive pulse is matched to the polarity of the coil 78 and the arrangement and polarity of the magnetic poles of the permanent magnet 60 in such a way that each drive pulse results in a deflection of the driving element 66 from the position of rest shown in FIG. 4 to the deflected position shown in FIG. 5. Subsequently, the reset spring 82 returns the driving element 66 in a counterclockwise direction as shown in FIGS. 4 and 5, until the resilient tongue 80 abuts the adjacent pillar 58. FIGS. 4 and 5 also show how driving element swings through a relatively large rotational angle, so that the energy required per driving pulse can be produced by pulses with relatively low peak current values, which is favorable as far as avoiding a battery voltage drop is concerned. Furthermore, FIGS. 4 and 5 show that the reset spring 82 is mounted in relation to the driving element 66 and engages the latter at such a point in relation to its pivot axis that the lever arm of the reset spring decreases during the deflecting motion, which also favorably affects optimal use of the electric energy owing to the simultaneous increase in the spring tension.

FIGS. 3, 4, and 5 clearly show that the plastic body 68 has a recess 92 formed by a step 90 on its front side, and a center wheel 94 is arranged in said recess between the plastic body 68 and the front shunt plate 50. This center wheel is secured to a center wheel staff 96 for whose bearing, bearing bores 98 and 100 are provided in both shunt plates 50 and 52. The toothing 102 of the center wheel 94 is formed by 60 saw teeth in which a leaf spring 104 secured to the upper shunt plate 50 engages, in order to position the center wheel. The leaf spring 104 therefore prevents the center wheel from turning backwards. A second leaf spring 106 is secured to the plastic body 68 serves to stepwise index the center wheel 94 as shown in FIGS. 4 and 5 in a clockwise direction, i.e., when the driving element 66 is deflected from its position of rest as shown in FIG. 4, the leaf spring 106 skips one tooth of the center wheel, so that, only when the driving element is reset with the aid of the spring 82, is the center wheel indexed and only by one tooth.

In order that shocks suffered by the watch which result in an inertia force on the minute hand and which would be apt to turn the center wheel clockwise cannot cause indexing at the improper time, two special features are present in the driving element 66: in the upper shunt plate 50 a pin 110 is inserted and abutted by the leaf spring 106 when the driving element 66 is in its position of rest, such that the leaf spring is enclosed almost without play between the respective adjacent tooth of the minute wheel 94 and the pin 110. Therefore, when the driving element 66 is in its position of rest it is impossible to advance the minute wheel 94 further. As known from the aforementioned German Utility Model Specification No. 7,146,975, a nose 112 was furthermore formed to the plastic body 68, said nose, when the driving element 66 assumes the completely deflected position (FIG. 5), engaging in the toothing 102 of the center wheel 94. This prevents the center wheel from being able to be turned further when the driving element assumes the position of greatest deflection.

The leaf spring 106 and the pin 110 act via an angle of rotation of the driving element 66 of up to 10 or 20 to prevent the center wheel 94 from being turned. However, in order to prevent damage to the leaf spring 106 when relatively large torques occuring often when hands which are difficult to move are being set, act on the center wheel, a further nose, 113 is formed to the plastic body 68 and engages in the toothing of the center wheel when the driving element 66 is in its rest position.

With the help of FIG. 2 the construction of the other parts of the gear train in the watch of the invention may be explained in the following.

In the front shunt plate 50 a bore for the bearing of an axis 114 is provided to which an intermediate wheel 116 is secured. This intermediate wheel meshes with a pinion 118 formed to a tube 120, and on the tube 120 positioned in frictional contact on the center wheel staff 96, a further tube 122 is rotatable mounted, to which an hour wheel 124 is secured which meshes with a pinion 126 which is firmly connected to the intermediate wheel 116. While the minute hand 108 is secured to the inner tube 120 the outer tube 122 bears the hour hand 130.

The torque is therefore transmitted from the minute wheel axis 96 to the inner tube 120 and thus to its pinion 118 which meshes with the intermediate wheel 116. Its pinion 126 drives the outer tube 122 via the hour wheel 124 and thereby moves the hour hand 130.

Owing to the fact that the inner tube is driven by the minute wheel axis 96 only due to friction, the hands 108 and 130 can be adjusted in the usual way independently of the minute wheel 94:

The rear side of the intermediate wheel 116 carries a gear ring 140 into which a pinion 142 fixed to the setting stem engages when the setting stem is pulled out of the watch a little way. Thus, by turning the setting stem the intermediate wheel can be rotated so that the hands can be set to a chosen time.

In the described preferred embodiment of the inventive watch the torque created by the driving pulses at the pivot axis of the driving element 66 amounts to approximately 5 to 7 (pond × millimeter). The torque produced by the reset spring 82 and decisive for the indexing of the minute wheel is approximately 3 to 3.5 p.mm and can be between 3 and 7 p.mm.

Tests by the applicant have shown that the shock insensitivity of the wrist watch of the invention is up to 40 times greater than in the known quartz wrist watches with analog indication.

It is understood that the quartz analog wrist watch of the invention does not have to be a watch with hands, but rather figure rings or the other indicating element could serve as analog indication.

Furthermore, it must be pointed out that both shunt plates can be formed from one single part whose cross-section is like a "U" on its side.

We claim:

1. In a quartz controlled analog wrist watch comprising a quartz controlled pulse generator and a driving element for driving a first toothed wheel of a gear train, said driving element being mounted for pivoting about an axis, a coil connected to receive the output pulses of the pulse generator, and a permanent magnet, said coil and said magnet being moveable relative to each other, for deflecting said driving element from a rest position, and further comprising a reset spring for returning the driving element to said rest position, the improvement comprising:

means causing the output pulses from the pulse generator to occur substantially less frequently than once per second, and means for directly indexing the first toothed wheel by said driving element in such a way that when the driving element is deflected, the reset string is tensioned and only when the driving element is returning under tension of said reset spring is the first toothed wheel indexed, said first toothed wheel being disposed to serve as the "center" wheel.

2. The improvement according to claim 1 wherein said pulses occur once per minute and wherein the first toothed wheel has 60 teeth.

3. The improvement according to claim 1, wherein the center wheel extends between two shunt plates of the permanent magnet which are disposed parallel to each other and in which the driving element and the center wheel are mounted.

4. The improvement according to claim 3, wherein an intermediate wheel driven via the center wheel axis is mounted in at least one of the shunt plates and the hour wheel is mounted on the center wheel axis.

5. The improvement according to claim 4, wherein the intermediate wheel and the hour wheel are arranged outside of the two shunt plates.

6. The improvement according to claim 1, wherein the driving element comprises a plastic body with molded on pivot pins.

7. The improvement according to claim 6 wherein said plastic body comprises a holding means, more particularly a molded-on holding pin for a counterweight for compensating for the coil carried by said plstic body.

8. The improvement according to claim 1 wherein said driving element carries a resilient arm for indexing the center wheel, said arm engaging in the teeth of the center wheel when the driving element is in its rest position and being prevented from deflection by means of a stop member.

9. The improvement according to claim 1, wherein said driving element is provided with a projection, more particularly a molded-on nose, said projection engaging in the teeth of the center wheel when the driving element is in the completely deflected position.

10. The improvement according to claim 1, wherein said driving element comprises a flexible portion, more particularly a molded-on resilient tongue which, when the driving element is in its rest position, abuts a stop member under the influence of the reset spring.

11. The improvement according to claim 1 wherein one side of its pivot axis, said driving element is approximately of the thickness of a flat coil mounted on one side and is of greater thickness on the other side of said axis.

12. The improvement according to claim 11 wherein in the area of its pivot axis said driving element comprises a step which on the side of the said axis facing away from the coil provides for a recess into which the center wheel extends.

13. The improvement according to claim 1, wherein the torque produced by the reset spring is approximately between 3 and 7 pond × millimeter p.mm.

14. The improvement according to claim 1, wherein said driving element is provided with a projection, more particularly a molded-on nose, said projection engaging in the teeth of the center wheel when the driving element is in its position of rest.

* * * * *